US011431118B2

(12) United States Patent
Hwang

(10) Patent No.: US 11,431,118 B2
(45) Date of Patent: Aug. 30, 2022

(54) ELECTRICAL CONNECTOR HAVING EXTENSION ARMS ELECTRICALLY CONNECTED WITH ELECTRONIC MODULE, EXTENSION ARMS EXTENDED FROM CONNECTING PART AND MULTIPLE CONNECTING PART

(71) Applicants: FOXCONN (KUNSHAN) COMPUTER CONNECTOR CO., LTD., Kunshan (CN); FOXCONN INTERCONNECT TECHNOLOGY LIMITED, Grand Cayman (KY)

(72) Inventor: Tzu-Yao Hwang, New Taipei (TW)

(73) Assignees: FOXCONN (KUNSHAN) COMPUTER CONNECTOR CO., LTD., Kunshan (CN); FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 17/134,537

(22) Filed: Dec. 28, 2020

(65) Prior Publication Data

US 2021/0203091 A1 Jul. 1, 2021

(30) Foreign Application Priority Data

Dec. 26, 2019 (CN) ..... 201911366345.8

(51) Int. Cl.
*H01R 12/70* (2011.01)
*H01R 13/05* (2006.01)

(52) U.S. Cl.
CPC ..... *H01R 12/7076* (2013.01); *H01R 13/05* (2013.01)

(58) Field of Classification Search
CPC ..... H01R 12/7076; H01R 13/05
USPC ..... 439/692
See application file for complete search history.

(56) References Cited

U.S. PATENT DOCUMENTS 5,984,697 A 11/1999 Moran et al.
7,252,563 B2 8/2007 Ju
7,559,811 B1 * 7/2009 Polnyi ..... H01R 4/4809 439/591
7,625,217 B1 * 12/2009 Liao ..... H01R 12/714 439/66

(Continued)

*Primary Examiner* — Peter G Leigh
(74) *Attorney, Agent, or Firm* — Ming Chieh Chang; Wei Te Chung

(57) ABSTRACT

An electrical connector for mating with the CPU unit, includes an insulative housing with a plurality of passageways extending therethrough in the vertical direction. A plurality of contacts are disposed within the corresponding passageways, respectively. Each contact includes opposite first retaining section and second retaining section with an upward resilient contacting section linked therebetween, and a soldering section extending downwardly from the first retaining section. The contacting section includes opposite first contacting part unitarily extending from the first retaining section, and second contacting part unitarily extending from the second retaining section. The CPU unit forms a plurality of metal-coated recesses in an underside to receive the contacting section of the corresponding contacts, respectively. The first retaining section is essentially immovable in the passageway while the second retaining section is essentially movable relative to the housing in response to mating with the CPU.

18 Claims, 4 Drawing Sheets

(56) References Cited

U.S. PATENT DOCUMENTS 7,927,109 B1 4/2011 Gattuso
7,988,501 B2 * 8/2011 Chang ..... H05K 7/1069 439/751
8,366,453 B2 * 2/2013 Chang ..... H01R 12/58 439/70
8,385,082 B2 * 2/2013 Chang ..... H05K 3/308 361/803
10,079,443 B2 * 9/2018 Costello ..... H01R 13/2442
10,276,953 B2 * 4/2019 Huang ..... H01R 12/57
10,326,225 B2 * 6/2019 Ju ..... H01R 12/7076
10,348,015 B2 * 7/2019 Mason ..... H01R 13/057
10,424,858 B2 * 9/2019 Ju ..... H01R 43/16
10,483,695 B2 * 11/2019 Cheng ..... H01R 4/02
10,490,944 B2 * 11/2019 Ju ..... H01R 13/646
2009/0047817 A1 * 2/2009 Liu ..... H01R 13/2492 439/296
2009/0247023 A1 * 10/2009 Liao ..... H01R 13/2442 439/862
2009/0253287 A1 * 10/2009 Polnyi ..... H01R 13/2457 439/331
2009/0263985 A1 * 10/2009 Liu ..... H01R 13/2492 439/66
2009/0269950 A1 * 10/2009 Liao ..... H01R 13/2492 439/66
2011/0053426 A1 3/2011 Cheng et al.
2018/0269613 A1 * 9/2018 Ju ..... H01R 12/7076
2018/0331442 A1 * 11/2018 Huang ..... H01R 13/2407
2018/0351276 A1 * 12/2018 Beaman ..... H01R 13/2492
2018/0351277 A1 * 12/2018 Beaman ..... H01R 12/57
2019/0140382 A1 * 5/2019 Ju ..... H01R 13/2457
2019/0148869 A1 * 5/2019 Ju ..... H01R 43/16 439/874
2019/0288454 A1 * 9/2019 Hwang ..... H01R 13/2442
2019/0326697 A1 * 10/2019 Ho ..... H01R 12/707
2019/0334272 A1 * 10/2019 Hsu ..... H01R 13/2435
2019/0334273 A1 * 10/2019 Hsu ..... H01R 13/15

* cited by examiner

ELECTRICAL CONNECTOR HAVING EXTENSION ARMS ELECTRICALLY CONNECTED WITH ELECTRONIC MODULE, EXTENSION ARMS EXTENDED FROM CONNECTING PART AND MULTIPLE CONNECTING PART

BACKGROUND OF THE INVENTION

1. Field of the Invention

The present invention relates to an electrical connector for use with a CPU (Central Processing Unit), and particularly to an interface arrangement between the contact and the CPU.

2. Description of Related Arts

The high speed transmission is required for the new communication system including the computer. The faster the signal transmission is, the more contacts the system requires. The traditional LGA (Land Grid Array) arrangement on the CPU may apply the normal force upon the corresponding contacts and the PCB (Printed Circuit Board) thereunder. When the amount of the contacts increases, the corresponding normal forces in the vertical direction is raised. When there are eight thousand more contacts, the corresponding normal force may reach two hundred and fifty kilograms, thus tending to damage either the connector or the PCB.

Therefore, it is desired to provide an electrical connector with a huge number of contacts for mating with the CPU while maintaining the relatively lower normal force for avoiding damaging either the electrical connector or the PCB thereunder

SUMMARY OF THE INVENTION

To achieve the above object, an electrical connector for mating with the CPU unit, includes an insulative housing with a plurality of passageways extending therethrough in the vertical direction. A plurality of contacts are disposed within the corresponding passageways, respectively. Each contact includes opposite first retaining section and second retaining section with an upward resilient contacting section linked therebetween, and a soldering section extending downwardly from the first retaining section. The contacting section includes opposite first contacting part unitarily extending from the first retaining section, and second contacting part unitarily extending from the second retaining section. The CPU unit forms a plurality of metal-coated recesses in an underside to receive the contacting section of the corresponding contacts, respectively. The first retaining section is essentially immovable in the passageway while the second retaining section is essentially movable relative to the housing in response to mating with the CPU.

Other advantages and novel features of the invention will become more apparent from the following detailed description of the present embodiment when taken in conjunction with the accompanying drawings.

DETAILED DESCRIPTION OF THE PREFERRED EMBODIMENT

Figure 1:
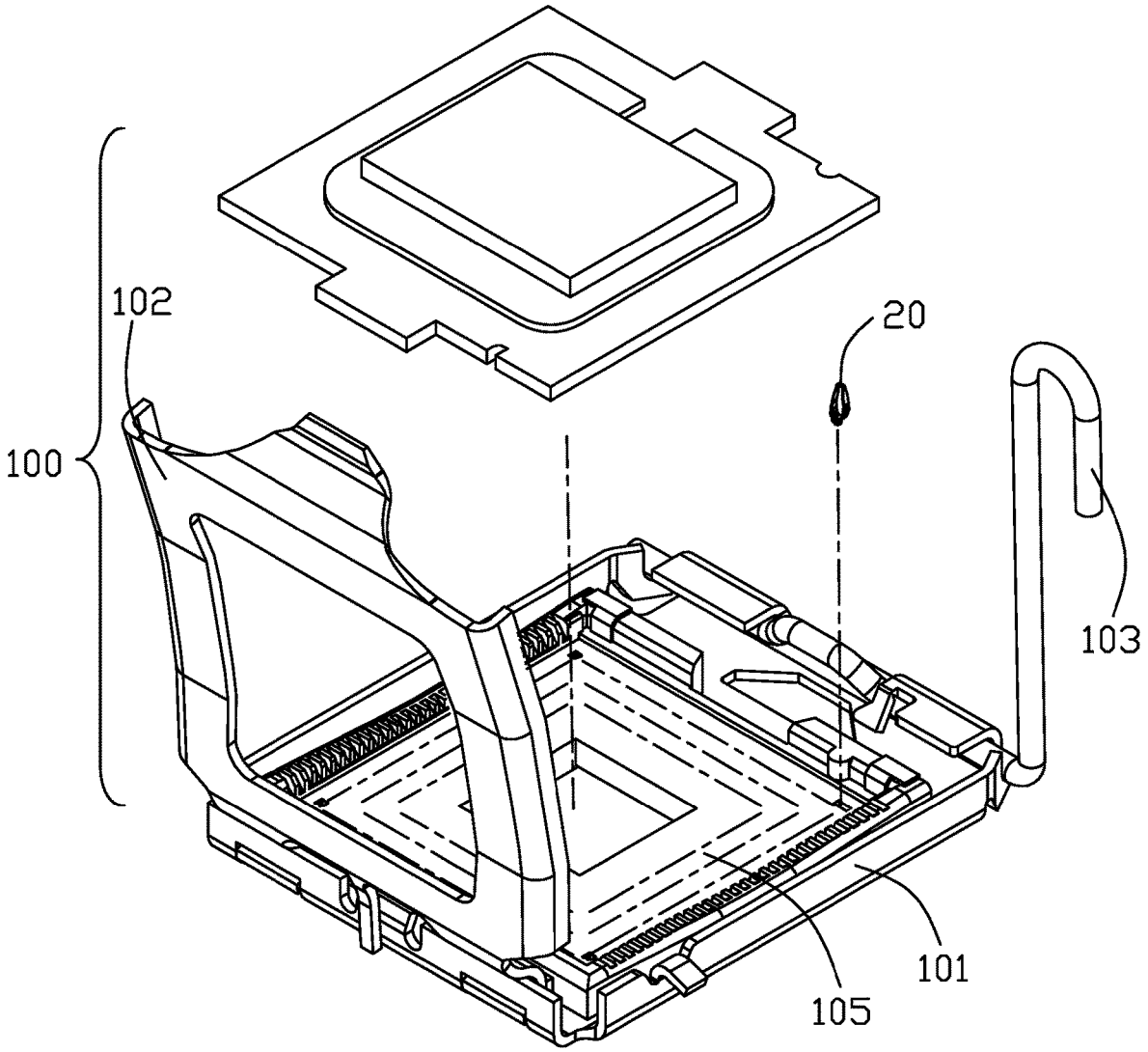
FIG. 1 is a perspective view of an electrical connector assembly of the invention.
Figure 2:
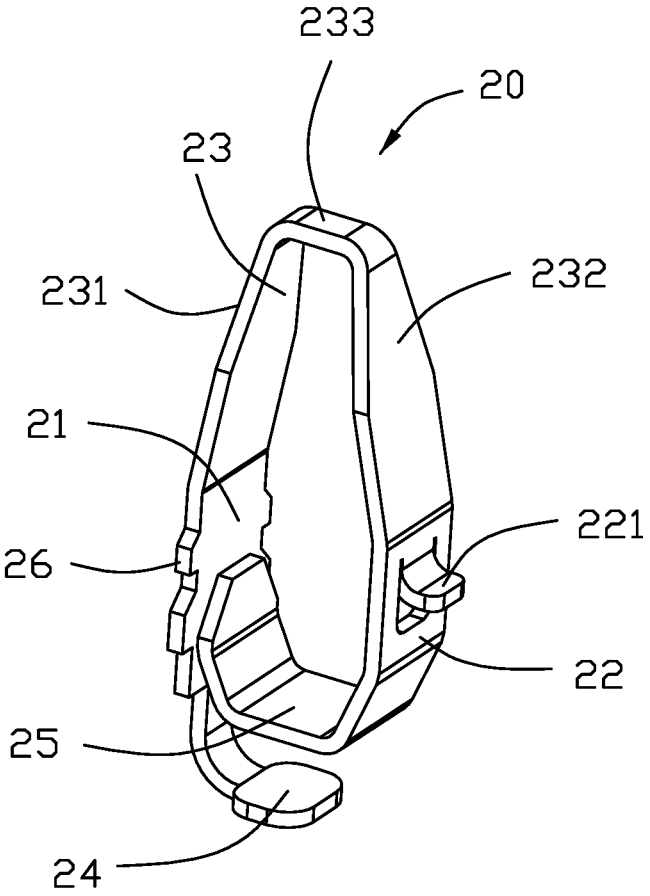
FIG. 2 is a perspective view of the electrical contact of the electrical connector assembly of FIG. 1.
Figure 3:
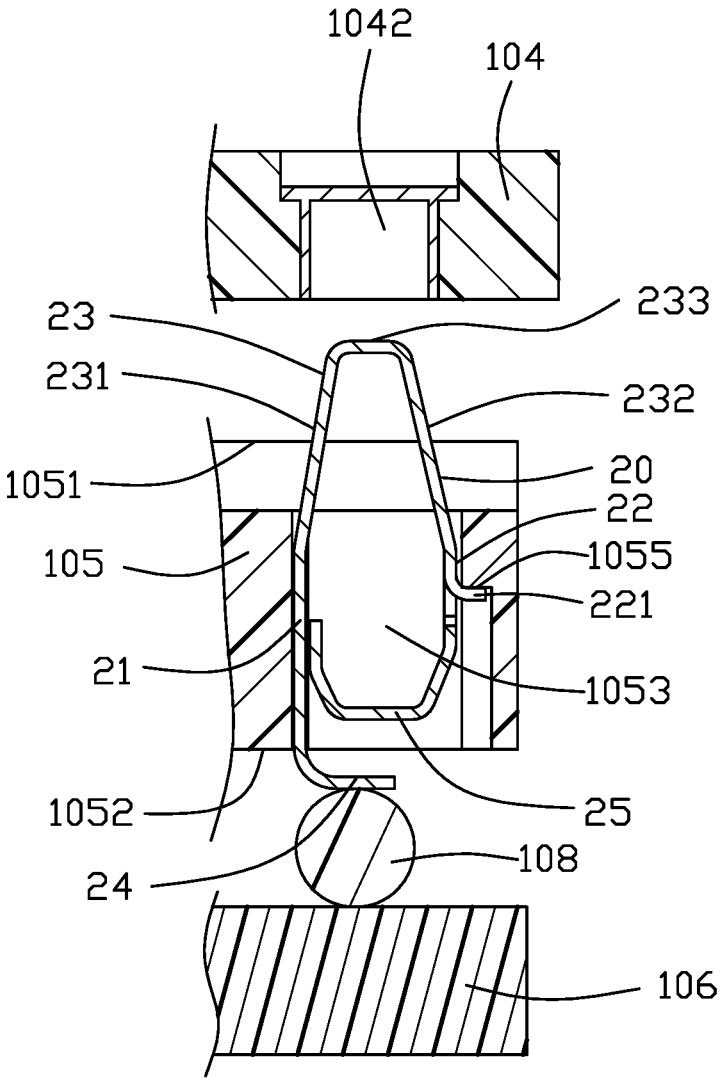
FIG. 3 is a cross-sectional view of the electrical connector assembly of FIG. 1.
Figure 4:
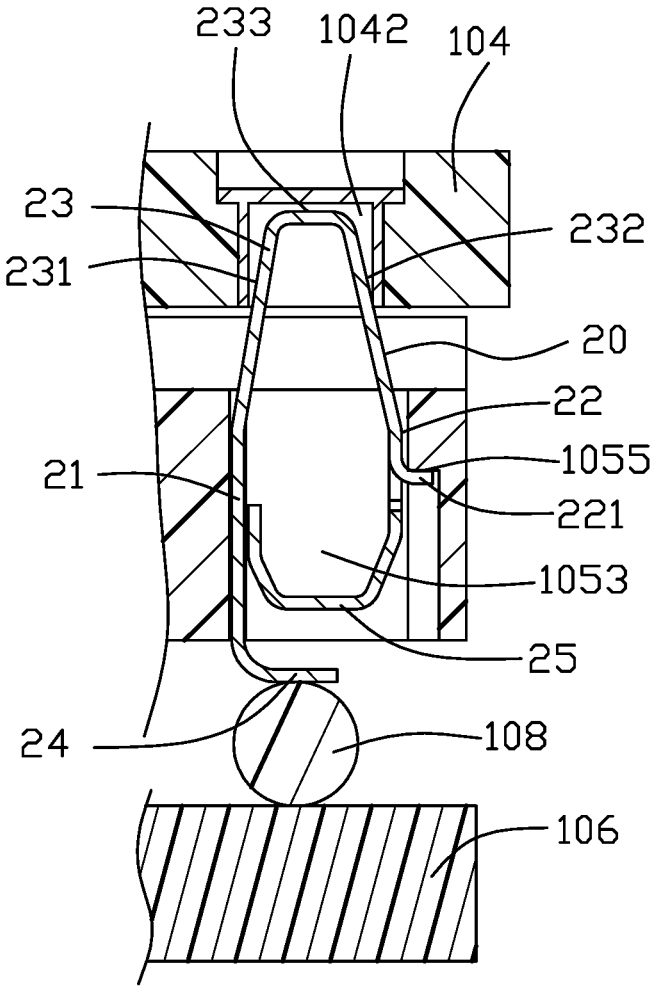
FIG. 4 is a cross-sectional view of the electrical connector assembly of FIG. 1 wherein the CPU is mated with the connector.

Referring to FIGS. 1-4, an electrical connector 100 for connecting a CPU or electronic package 104 to the PCB 106, includes an insulative housing 105 with a plurality of passageways 1053 extending through opposite upper surface 1051 and lower surface 1052 of the housing 105. A plurality of contacts 20 are disposed in the corresponding passageways 1053, respectively. A metallic stiffener 101 surrounds the electrical connector 100, a load plate 102 pivotally mounted upon end of the stiffener 101 for downwardly pressing the CPU 104, and a lever 103 pivotally mounted upon the other end of the stiffener 101 for downwardly pressing the load plate 102. Different from the traditional CPU which is equipped with the LGA pads on the undersurface, a plurality of conductive recesses 1042 are formed in an undersurface of the CPU 104 in the invention.

Each contact 20 includes a first retaining section 21 and a second retaining section 22 spaced from and opposite to each other in a first horizontal direction with a contacting section 23 linked therebetween at corresponding upper ends thereof. The contacting section 23 upwardly protrudes out of the upper surface 1051. A soldering section 24 extends from a lower end of the first retaining section 21 with a solder ball 108 thereunder.

The contacting section 23 includes a first contacting part 231 downwardly linked with the first retaining section 21, and a second contacting part 232 downwardly linked with the second retaining section 22. The first contacting part 231 and the second contacting part 232 are upwardly converged toward each other with a horizontal third contacting part 233 linked therebetween at corresponding upper ends thereof. In this embodiment, the width of the third contacting part 233 is smaller than that of the first contacting part 231 and that of the second contacting part 232.

When the CPU 104 is mated within the electrical connector 100, the resilient contacting section 23 is inserted and received within the corresponding conductive recess 1042 which is coated with a metal layer as a via structure. Because the first contacting part 231 and a second contacting part 232 may provide resilient forces in the horizontal/transverse direction against the conductive layer in the corresponding recess 1042 for establishing the election connector, the connector 100 and the PCB 106 thereunder may not improperly endure the significant normal forces in the vertical direction. The horizontal third contacting part 233 may optionally contact the conductive layer in the vertical direction for enhancing the election connection between the contact 20 and the corresponding conductive recess 1042. In other words, the invention provides three contacting points, i.e., one in the vertical direction and two in the horizontal direction, compared with the traditional design with only one contacting point in the vertical direction.

In this embodiment, the first retaining section 21 is parallel to the second retaining section 22. The first retaining section 21 forms barbs 26 on two lateral sides. The second retaining section 22 forms a hook 221 engageable with the corresponding step 1055 for avoiding upward movement of the second retaining section 22 during unloading the CPU 104 away from the housing 105. A stopper 25 is formed on a bottom end of the second retaining section 22 to abut against the first retaining section 21 in the first horizontal direction to function as a supporting structure for enhancing resiliency of the contacting section 23

In brief, the contact 20 itself forms a loop structure for providing multiple transmission paths electrically, and a trough like contacting section for providing multiple contacting points electrically, both of which improve the electrical performance as well as the mechanical performance.

Although the present invention has been described with reference to particular embodiments, it is not to be construed as being limited thereto. Various alterations and modifications can be made to the embodiments without in any way departing from the scope or spirit of the present invention as defined in the appended claims.

What is claimed is:

1. An electrical connector assembly comprising:

an electrical connector including an insulative housing with a plurality of passageways extending therethrough in a vertical direction;

a plurality of contacts disposed within the corresponding passageways, respectively, each of the contacts including a first retaining section and a second retaining section space from and opposite to each other in a first horizontal direction perpendicular to the vertical direction with a contacting section linked therebetween at corresponding upper ends thereof; wherein the first retaining section includes a barbed structure engaged with the housing for securing the contact in the passageway, and the contacting section provides multiple contacting points above the housing when mating with an electronic package; and the electronic package forms a plurality of conductive recesses in an underside thereof to receive the contacting sections of the corresponding contacts, respectively.

2. The electrical connector assembly as claimed in claim 1, wherein the contacting section includes a first contacting part unitarily extending upwardly from the upper end of the first retaining section, and a second contacting part unitarily extending upwardly from the upper end of the second retaining section and opposite to the first contacting part in the first horizontal direction, and a third contacting part linked between corresponding upper ends thereof.

3. The electrical connector assembly as claimed in claim 2, wherein the first contacting part and the second contacting part are converged toward each other upwardly.

4. The electrical connector assembly as claimed in claim 3, wherein the third contacting part extends in the first horizontal direction.

5. The electrical connector assembly as claimed in claim 2, wherein a width dimension of the third contacting part is smaller than those of the first retaining section and second retaining section in a second horizontal direction perpendicular to the first horizontal direction.

6. The electrical connector assembly as claimed in claim 1, wherein the second retaining section forms a hook to be upwardly engaged with a step in the corresponding passageway.

7. The electrical connector assembly as claimed in claim 1, wherein a stopper is formed on a bottom end of the second retaining section to abut against the first retaining section in the first horizontal direction.

8. The electrical connector assembly as claimed in claim 7, wherein a soldering section is formed at a bottom end of the first retaining section below the stopper in the vertical direction perpendicular to the first horizontal direction to attach a solder ball thereon for mounting to a printed circuit board.

9. The electrical connector assembly as claimed in claim 7, wherein the first retaining section, the contacting section, the second retaining section and the stopper commonly form a loop structure viewed along a second horizontal direction perpendicular to both the vertical direction and the first horizontal direction.

10. The electrical connector assembly as claimed in claim 1, wherein the first retaining section is essentially immovable relative to the housing while the second retaining section is essentially slightly moveable relative to the housing in response to mating with the electronic package.

11. A contact for use within an electrical connector, comprising:

a first retaining section extending in a first vertical plane;

a second retaining section extending in a second vertical plane spaced from the first vertical plane in a first horizontal direction;

a contacting section linked between corresponding upper ends of the first retaining section and the second retaining section; wherein the first retaining section forms a barbed structure for engagement with an insulative housing of the electrical connector in an immovable manner, and the second retaining section forms a hook for engagement with the insulative housing of the electrical connector in a movable manner; and a stopper is formed at a bottom end of the second retaining section to abut against the first retaining section in the first horizontal direction.

12. The contact as claimed in claim 11, wherein the first retaining section, the contacting section, the second retaining section and the stopper commonly form a loop structure, viewed in a second horizontal direction perpendicular to the first horizontal direction.

13. The contact as claimed in claim 12, wherein a soldering section is formed at a bottom end of the first retaining section below the stopper in a vertical direction perpendicular to both the first horizontal direction and the second horizontal direction.

14. The contact as claimed in claim 12, wherein the contacting section defines an upside-down trough configuration viewed along the second horizontal direction.

15. A method of connecting an electronic package upon an electrical connector, comprising steps of:

providing an insulative housing with a plurality of passageways extending therethrough in a vertical direction;

upwardly assembling a plurality of contacts into the corresponding passageways from a bottom side of the housing, respectively; wherein each contact includes a first retaining section and a second retaining section spaced from each other in a first horizontal direction perpendicular to the vertical direction, a contacting section linked at corresponding upper ends of the first retaining section and the second retaining section with multiple contacting points above an upper surface of the housing; and providing an electronic package with a plurality of conductive recesses in an undersurface thereof, wherein during mating, the contacting sections are respectively received within the corresponding conductive recesses, respectively performing multiple contacting points coupling therewith.

16. The method as claimed in claim 15, wherein the contacting section defines an upside-down trough configuration above the upper surface of the housing, viewed along a second horizontal direction perpendicular to both the vertical direction and the first horizontal direction.

17. The method as claimed in claim 16, wherein the contact defines a loop configuration viewed along the second horizontal direction.

18. An electrical connector assembly comprising:

an electrical connector including an insulative housing with a plurality of passageways extending therethrough in a vertical direction;

a plurality of contacts disposed within the corresponding passageways, respectively, each of the contacts including a first retaining section and a second retaining section space from and opposite to each other in a first horizontal direction perpendicular to the vertical direction with a contacting section linked therebetween at corresponding upper ends thereof; wherein the first retaining section includes a barbed structure engaged with the housing for securing the contact in the passageway, and the contacting section provides multiple contacting points above the housing when mating with an electronic package;

a stopper is formed on a bottom end of the second retaining section to abut against the first retaining section in the first horizontal direction; and the first retaining section, the contacting section, the second retaining section, and the stopper commonly form a loop structure viewed along a second horizontal direction perpendicular to both the vertical direction and the first horizontal direction.

* * * * *